United States Patent [19]

Muehlbauer

[11] 3,965,805

[45] June 29, 1976

[54] SPRAY FINISHING TUNNEL

[75] Inventor: James H. Muehlbauer, Evansville, Ind.

[73] Assignee: George Koch Sons, Inc., Evansville, Ind.

[22] Filed: June 9, 1975

[21] Appl. No.: 584,721

[52] U.S. Cl. ..... 98/115 SB; 55/240; 118/DIG. 7; 118/312; 118/326

[51] Int. Cl.[2] ..... F23J 11/12

[58] Field of Search ..... 98/115 R, 115 SB, 36; 118/DIG. 7, 312, 326; 427/421, 424; 55/223, 240, 241

[56] References Cited

UNITED STATES PATENTS

| | | | |
|---|---|---|---|
| 2,230,646 | 2/1941 | Klausmeyer | 98/115 SB |
| 3,170,384 | 2/1965 | Krantz et al. | 98/115 SB X |
| 3,391,630 | 7/1968 | Wilhelmsson | 98/115 SB |
| 3,807,291 | 4/1974 | Roberts et al. | 98/115 SB |

*Primary Examiner*—William F. O'Dea
*Assistant Examiner*—Ronald C. Capossela
*Attorney, Agent, or Firm*—Jenkins, Hanley & Coffey

[57] ABSTRACT

A spray-finishing system including a tunnel through which objects to be finished longitudinally move and a chamber under the tunnel and in communication with the tunnel through the grill-type floor. The chamber is exhausted by conventional exhaust fan techniques. The improvement comprises a longitudinally extending divider dividing the chamber into lateral subchambers from which the air is exhausted. The divider provides, for each subchamber, a longitudinally and downwardly extending wall surface terminating at its lower extremity into a laterally relatively narrow trough which is relatively steeply inclined longitudinally downwardly. In each subchamber, a longitudinally extending, inwardly and downwardly sloping panel is provided having a distal edge spaced apart from the wall surface to provide a longitudinally extending, laterally narrow slot through which the air drawn from the subchamber moves. A film of washing liquid flows down the wall surfaces respectively to the troughs and down the panels respectively toward the wall surfaces. The troughs, being steeply inclined, flow the washing liquid longitudinally along the subchambers at a relatively high speed.

16 Claims, 2 Drawing Figures

SPRAY FINISHING TUNNEL

The present invention relates to spray-finishing systems or spray painting tunnels, and more particularly to the provision of such a system comprising a novel and very advantageous structure for handling the required washing liquid and ventilating air flow.

Spray painting tunnels of the type with which the present invention is connected are shown, for instance, in U.S. Pats. No. 3,170,384 issued Feb. 23, 1965 and U.S. Pat. No. 3,391,630 issued July 9, 1968. The present invention is believed to be a significant improvement over such prior art spray painting tunnels for several reasons.

While prior art tunnels conventionally have a liquid wash trough thereunder which is laterally nearly as wide as the tunnel, the tunnel of the present invention is constructed to include only two laterally relatively narrow, longitudinally relatively steeply inclined troughs for carrying the necessary wash liquid through the tunnels.

The preferred tunnel is divided such that it has a pair of laterally spaced apart subchambers under the floor of the tunnel with each subchamber having its own wash liquid trough. The means dividing the chamber under the floor of the tunnel into subchambers may serve as supports for the floor of the tunnel and even for the conveyor moving through the tunnel. The dividing means may also be constructed to provide a longitudinally extending workmen's space to be described hereinafter.

It is an object of the present invention, therefore, to provide such a spray-finishing tunnel with a chamber below its floor and in which the improvement comprises longitudinally extending means for dividing the chamber into lateral subchambers from which air is exhausted by the exhausting means, the dividing means providing, for each subchamber, a longitudinally and downwardly extending wall surface having a lower extremity. Each subchamber includes a longitudinally extending trough adjacent the lower extremity and a longitudinally extending, inwardly and downwardly sloping panel providing a distal edge spaced apart from the wall surface to provide a longitudinally extending laterally narrow slot through which the air from the subchamber moves to the exhaust means. Then, means for supplying a film of washing liquid flowing down the wall surfaces respectively to the troughs and means for supplying a film of washing liquid flowing down the panels respectively toward the wall surfaces are provided.

Other objects and features of the present invention will become apparent as this description progresses.

Figure 1:
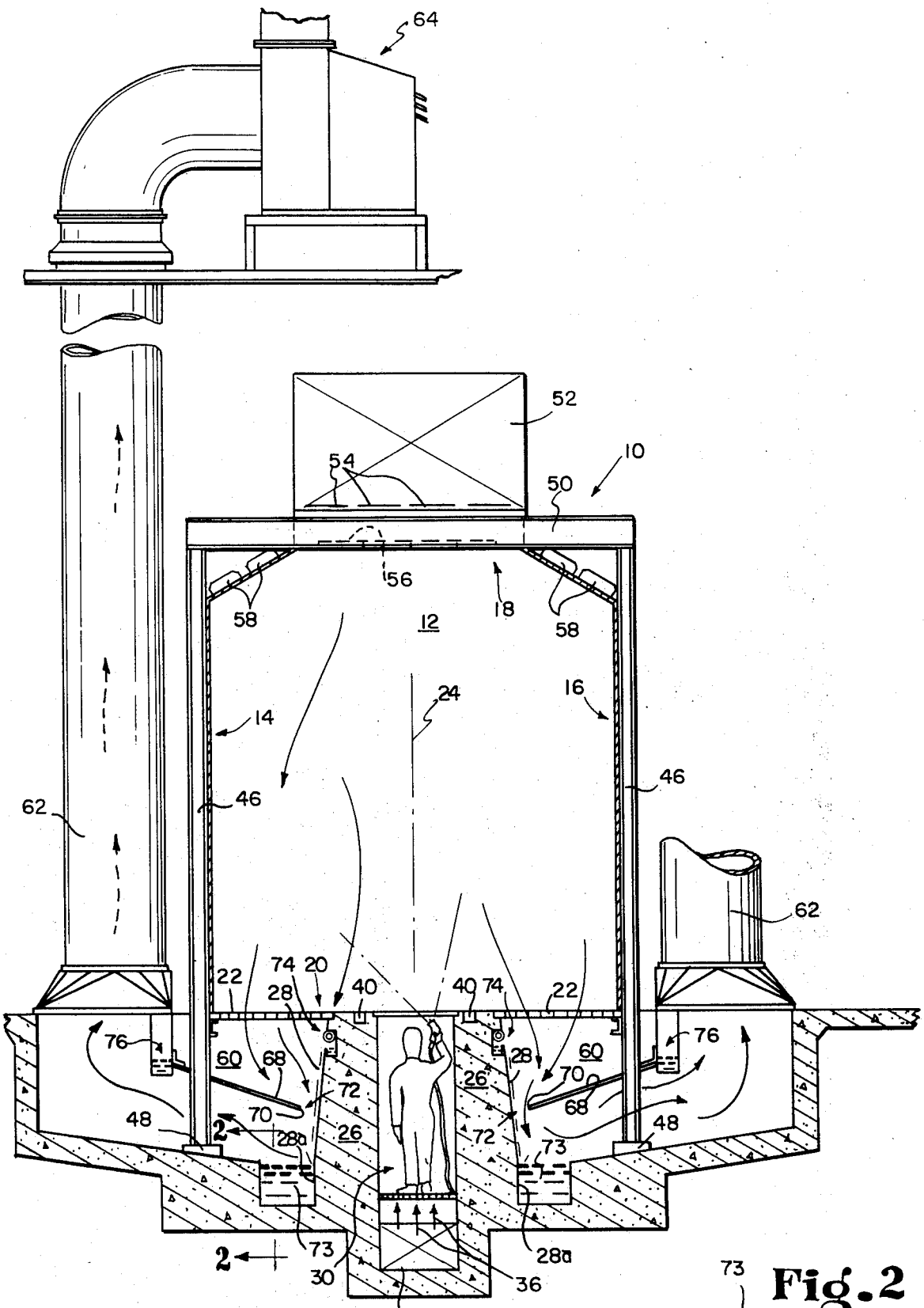
FIG. 1 is a cross sectional view of the tunnel of the present invention.
Figure 2:
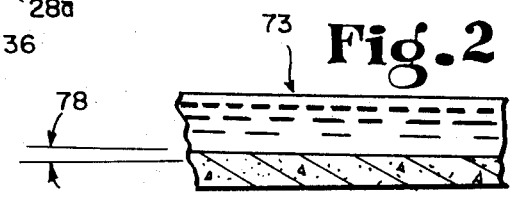
FIG. 2 is a fragmentary sectional view taken along the lines 2—2 in FIG. 1.

Referring particularly to the drawing, the illustrative finishing system 10 is shown comprising a tunnel 12 having side walls 14,16, ceiling 18 and floor 20, a primary portion of which is an open grill as indicated at 22. The center-line of the tunnel is indicated by the reference numeral 24 to illustrate that the tunnel may be symmetrically constructed about the longitudinal center-line.

In the illustrative embodiment, the tunnel 12 is supported on a poured concrete foundation or form which is shaped to provide a chamber under the tunnel and in communication with the tunnel through the grill work 22. In the illustrative embodiment, the concrete is formed to provide a pair of laterally spaced apart, longitudinally and upwardly extending walls 26 on opposite sides of the center-line 24, the walls being formed to provide downwardly and slightly outwardly inclined wall surfaces 28 having lower extremity portions **28*a*. The walls 26 are separated laterally to provide a longitudinal work space 30 therebetween in which one or more painters may stand to spray paint or other finishing materials upwardly at the objects moving through the tunnel 12. The painters will stand on a grill-work floor 32 below which preferably will be an air supply duct 34 arranged to distribute ventilating air directly upwardly as indicated by the arrows 36**.

The upper edges of the walls 26 serve as supports for the floor 20 and, because of their strength, may serve also as supports for the conveyor which moves objects through the tunnel, conveyor tracks being indicated at 40. While the details of the structure of the tunnel 12 are not vitally important to the present invention, the walls 14,16 may be defined primarily by the illustrative vertical posts 46 supported on mounting pads 48 and joined at their tops by cross members 50. Such a construction will permit, for instance, the installation of an air supply plenum 52 above the tunnel space and including slide dampers 54 and filters 56. Air is distributed from the plenum 52 downwardly toward the objects being finished. Lights such as indicated at 58 may also be suspended from the ceiling to provide light for workmen.

The two walls 26 constitute means for dividing the chamber below the floor 20 into laterally spaced apart, longitudinally extending subchambers 60 which are exhausted, respectively, by ducts 62. The left-hand duct 62 is shown connected to a rather large exhaust fan means 64.

Within each subchamber 60, a longitudinally extending panel 68 inclines downwardly and inwardly to provide a distal edge 70 spaced apart from the wall surface 28 to provide a laterally relatively narrow, longitudinally extending slot 72 through which the air exhausted from the subchamber moves. It will be appreciated that this laterally relatively narrow slot 70 serves a constriction such that the air moving therethrough is at a relatively high velocity downwardly toward the illustrated longitudinally extending, laterally relatively narrow wash liquid trough 73. In the illustrative embodiment, the lower extremity portions **28*a* of the walls 28 form one wall of the troughs 73. The slots 72 are disposed above and in vertical registry with the troughs. Means indicated at 74 are provided for supplying a film of washing liquid flowing down the wall surfaces 28 respectively to the troughs, and means indicated at 76 are provided for supplying a film of washing liquid flowing down the panels 68 respectively toward the wall surfaces 28. In other words, the washing liquid on the wall surfaces 28 and on the panels 68 flows through the slots 72 with the high velocity exhausted air. The washing liquid, of course, carries with it droplets of the finishing material. The high velocity of the air moving downwardly through the slots 72 carries the droplet laden wash liquid downwardly to the troughs 73. Because of this velocity, it is unlikely that the droplets will move laterally outwardly and then upwardly to be exhausted through the ducts 62.**

Not only is the wash liquid accelerated downwardly by the air flow, the troughs 73 are relatively steeply inclined to provide a fast flow of wash liquid longitudinally therealong. This fast flow of wash liquid in the troughs serves more effectively to trap the finishing material droplets in the wash liquid. The inclination 78 of the troughs 73 may be about one degree or more to cause high velocity flow of the wash liquid. Each of troughs 73, for instance, may be only about 2 feet wide while the tunnel 12 may be about 14 feet wide. The slots 72 above the troughs 73 may be, for instance, approximately three inches wide.

The duct 34 also may be provided as an exhaust duct to draw air from the tunnel 12.

I claim:

1. A spray-finishing system including a tunnel through which objects to be finished longitudinally move, said tunnel having a pair of spaced longitudinal side walls, a floor defined, at least in part, by a grill through which air moves, means for distributing air within said tunnel and onto the objects being sprayed, means defining a chamber under said tunnel and in communication with said tunnel through said grill, and means for exhausting said chamber, in which the improvement comprises longitudinally extending means for dividing said chamber into lateral subchambers from which air is exhausted by said exhausting means, said dividing means providing, for each subchamber, a longitudinally and downwardly extending wall surface having a lower extremity, each subchamber including a longitudinally extending trough adjacent the lower extremity, each subchamber also including a longitudinally extending, inwardly and downwardly sloping panel providing a distal edge spaced apart from said wall surface to provide a longitudinally extending, laterally narrow slot through which the air drawn from said subchamber moves, means for supplying a film of washing liquid flowing down said wall surfaces respectively to said troughs, and means for supplying a film of washing liquid flowing down said panels respectively toward said wall surfaces.

2. The improvement of claim 1 in which each said trough is relatively steeply inclined longitudinally downwardly to flow said washing liquid along said subchamber at a relatively high speed.

3. The improvement of claim 1 in which each said trough is inclined longitudinally downwardly at an angle greater than about 1° to flow said washing liquid at a high velocity along said subchamber.

4. The improvement of claim 1 in which each said dividing means wall surface inclines downwardly and slightly outwardly.

5. The improvement of claim 1 in which each said slot is disposed in vertical registry with the trough of said subchamber.

6. The improvement of claim 1 in which said troughs are laterally narrow relative to said subchambers and relatively steeply inclined longitudinally downwardly to provide fast movement of said washing liquid therein, said slots being disposed generally above said troughs.

7. The improvement of claim 6 in which said dividing means wall surfaces incline downwardly and slightly outwardly and terminate at their lower extremities in said troughs.

8. The improvements of claim 1 in which said dividing means includes a pair of laterally spaced apart, longitudinally and upwardly extending walls providing, respectively, said wall surfaces and defining therebetween a workmen's space, said walls serving as supports for said floor.

9. The improvement of claim 8 including means in said workmen's space for distributing air upwardly toward such objects moving through the tunnel.

10. The improvement of claim 9 in which said troughs are laterally narrow relative to said subchambers and relatively steeply inclined longitudinally downwardly to provide fast movement of said washing liquid therein, said slots being disposed generally above said troughs.

11. The improvement of claim 10 in which said dividing means wall surfaces incline downwardly and slightly outwardly and terminate at their lower extremities in said troughs.

12. A spray-finishing system including a tunnel through which objects to be finished longitudinally move, said tunnel having a pair of spaced longitudinal side walls, a floor defined, at least in part, by a grill through which air moves, means for distributing air within said tunnel and onto the objects being sprayed, means defining a chamber under said tunnel and in communication with said tunnel through said grill, and means for exhausting said chamber, in which the improvement comprises means providing a longitudinally and downwardly extending wall surface in said chamber having a lower extremity, a longitudinally extending trough adjacent said lower extremity, and a longitudinally extending, inwardly and downwardly sloping panel providing a distal edge spaced apart from said wall surface to provide a longitudinally extending, laterally narrow slot through which the air drawn from said chamber moves, means for supplying a film of washing liquid flowing down said wall surface to said trough and means for supplying a film of washing liquid flowing down said panel toward said wall surface, said trough being relatively steeply inclined longitudinally downwardly to flow said washing liquid along said chamber at a relatively high speed.

13. The improvement of claim 12 in which said trough is laterally narrow relative to said chamber, said slot being disposed above said trough.

14. A spray-finishing system including a tunnel through which objects to be finished longitudinally move, said tunnel having a pair of spaced longitudinal side walls, a floor defined, at least in part, by a grill through which air moves, means for distributing air within said tunnel and onto the objects being sprayed, means defining a chamber under said tunnel and in communication with said tunnel through said grill, and means for exhausting said chamber, in which the improvement comprises longitudinally extending means for dividing said chamber into lateral subchambers from which air is exhausted by said exhausting means, said dividing means providing, for each subchamber, a longitudinally and downwardly extending wall surface, each subchamber including a longitudinally extending trough, each subchamber also including a longitudinally extending, inwardly and downwardly sloping panel providing a distal edge spaced apart from said wall surface to provide a longitudinally extending, laterally narrow slot through which the air drawn from said subchamber moves, means for supplying a film of washing liquid flowing down said wall surfaces respectively to said troughs, and means for supplying a film of washing liquid flowing down said panels respectively toward said wall surfaces.

15. A spray-finishing system including a tunnel through which objects to be finished longitudinally move, said tunnel having a pair of spaced longitudinal side walls, a floor defined, at least in part, by a grill through which air moves, means for distributing air within said tunnel and onto the objects being sprayed, means defining a chamber under said tunnel and in communication with said tunnel through said grill, and means for exhausting said chamber, in which the improvement comprises means providing a longitudinally and downwardly extending wall surface in said chamber, a longitudinally extending trough, and a longitudinally extending, inwardly and downwardly sloping panel providing a distal edge spaced apart from said wall surface to provide a longitudinally extending, laterally narrow slot through which the air drawn from said chamber moves, means for supplying a film of washing liquid flowing down said wall surface to said trough and means for supplying a film of washing liquid flowing down said panel toward said wall surface, said trough being inclined longitudinally downwardly to flow said washing liquid along said chamber at a relatively high speed.

16. The improvement of claim 8 including exhaust means in said workmen's space for drawing air from said tunnel.

* * * * *